US006785925B1

(12) United States Patent
Donaldson

(10) Patent No.: US 6,785,925 B1
(45) Date of Patent: Sep. 7, 2004

(54) BRIDGE SYSTEM

(76) Inventor: Curtis L. Donaldson, 2860 R St., Lincoln, NE (US) 68503

( * ) Notice: Subject to any disclaimer, the term of this patent is extended or adjusted under 35 U.S.C. 154(b) by 0 days.

(21) Appl. No.: 10/412,071

(22) Filed: Apr. 11, 2003

Related U.S. Application Data

(60) Provisional application No. 60/372,607, filed on Apr. 15, 2002.

(51) Int. Cl.[7] ..... E01D 19/16; E01D 19/14; E01D 18/00

(52) U.S. Cl. ..... 14/22; 14/18; 14/21

(58) Field of Search ..... 14/18, 20–22, 14/78; 52/83; 404/18, 19, 20, 21, 22, 77.1, 78

(56) References Cited

U.S. PATENT DOCUMENTS

| | | | | | |
|---|---|---|---|---|---|
| 511,605 | A | | 12/1893 | Frederick | |
| 951,874 | A | * | 3/1910 | Wood | 238/11 |
| 2,311,241 | A | * | 2/1943 | Martin | 14/21 |
| 2,842,786 | A | | 7/1958 | Digby-Smith et al. | |
| 2,878,498 | A | * | 3/1959 | Dieter | 14/22 |
| 3,114,161 | A | | 12/1963 | Colombot | |
| 4,062,081 | A | * | 12/1977 | Ramer | 14/2.4 |
| 4,457,035 | A | * | 7/1984 | Habegger et al. | 14/18 |
| 4,535,498 | A | * | 8/1985 | Webster | 14/18 |
| 4,710,994 | A | * | 12/1987 | Kishida et al. | 14/77.1 |
| 5,513,408 | A | | 5/1996 | Minakami et al. | 14/18 |

FOREIGN PATENT DOCUMENTS

| | | |
|---|---|---|
| SU | 1249093 | 8/1986 |
| SU | 1408009 | 7/1988 |

* cited by examiner

*Primary Examiner*—Heather Shackelford
*Assistant Examiner*—Raymond W Addie
(74) *Attorney, Agent, or Firm*—James D. Welch

(57) ABSTRACT

A modified suspension bridge which comprises a continuous cable in which tension is developed by operation of turnbuckles or the like, instead of hanging weights.

7 Claims, 2 Drawing Sheets

BRIDGE SYSTEM

This Application Claims Benefit from Provisional Application Ser. No. 60/372,607 filed Apr. 15, 2002.

TECHNICAL AREA

The disclosed invention relates to bridges, and more particularly to a modified suspension-type bridge which comprises a continuous cable in which tension is developed by operation of turnbuckles or the like, instead of hanging weights.

BACKGROUND

Conventional Suspension Bridges which have weights hanging from a Tension Cable where it comes off a pulley or functional equivalent, are known. The weights are balance for the Bridge Deck Load supported by Tension Cables which attach from the tops of vertically projecting supports located substantially at the ends of the Bridge Deck. The Tension Cables project centrally from the tops of the vertically projecting supports and affix to said Bridge Deck. The Brooklyn Bridge, for instance, is such a Bridge which has huge weights so hanging therefrom.

Cable Stayed Bridges are also known, in which typically vertically projecting supports are placed at approximately one-quarter the length of the Bridge Deck, from each extend thereof. Tension Cables project both centrally and laterally from the tops of each of the Supports, with the portions of the Bridge Deck located Laterally on each side of the supports providing the equivalent of the weights in a Conventional Suspension Bridge.

It is also known to apply turnbuckles in bridge construction, wherein said turnbuckles are used to effect cable tension.

No known bridge, however, replaces weights in a conventional Suspension Bridge, with a continuous cable/turnbuckle combination which continuous cable is present under a Bridge Deck.

With the invention disclosed herein, a Search of Patents was conducted.

Perhaps the best art found is in a Patent to Minakami et al., No. 5,513,408. FIG. 7 therein shows a bridge with upper (24) and lower (25) cables. Said upper and lower cables however are not continuous around pulleys at their connection to element (3) therein, and there are no turnbuckles present to provide tension.

A Soviet Patent, No. SU 1408-009-A identifies an element termed a "regulation device" (6) at an interconnection between upper (5) and lower (7) cables, however the presence of pulleys are not indicated.

U.S. Pat. No. 2,311,241 to Martin identifies hydraulic jacks (62) as means for tension development.

U.S. Pat. No. 511,605 to Frederick identifies eye-bolts in cable (K), which can be replaced by turnbuckles.

U.S. Pat. No. 2,842,786 to Digby-Smith identifies tension producing nuts (12) applied to cable (2).

Additional Patents turned-up are:

U.S. Pat. No. 4,535,498 to Webster;

U.S. Pat. No. 3,114,161 to Colombot;

Soviet Patent No. SU 1249-093-A.

Even in view of the known prior art, need remains for improved a modified cable stayed bridge.

DISCLOSURE OF THE INVENTION

The disclosed invention is a bridge system comprising, as viewed in side elevation:

an elongated lower support which comprises cable directing means, (eg. a pulley or functional equivalent at each end thereof;

a cantered right support;

a cantered left support;

a tension cable with a tension producing means (eg. a turnbuckle) therein; and suspension cables. Said cantered right support is oriented at an angle upward and to the left and said left cantered support is oriented at an angle upward and to the right, lower ends each thereof being fixed upon and secured in a separate underlying right and left support abutments. The suspension cables are affixed to tops of said right and left supports and each is affixed centrally therebetween to said elongated lower support. The tension cable is affixed to the tops of said right and left supports and is strung through said pulleys or functional equivalents at the ends of said elongated lower support, and said tension cable is functionally continuous under said elongated lower support.

The disclosed invention can be more precisely described as a bridge system comprising right and left half-bridge systems, each said half section being as described above. Said right and left half-bridge systems are aligned one in front of the other as viewed in side elevation, but are offset from one another as viewed in frontal elevation, (eg. as viewed at an entry/exit to the bridge). Said right and left half-bridge systems are secured in relative position with respect to one another, via interconnection means and the elongated lower support.

The elongated lower support means is typically comprised of many sections.

It is also to be noted that the tension cable is affixed to the tops of the supports, and that said tension cable which passes over said pulleys can have a tension producing means, (eq. turnbuckle), included therewithin which when operated create tension therein.

A method of constructing a modified suspension bridge comprises the steps of:

a. providing right and left abutments separated by a distance;

b. mounting two right cantered supports, each, as viewed in side elevation, oriented at an angle upward and to the left, to said right abutment; and mounting two left cantered supports, each, as viewed in side elevation, oriented at an angle upward and to the right, to said left abutment; said two right and two left cantered supports being separated from one another as viewed in frontal elevation, and, as viewed in side elevation, said two right cantered supports being one in front of the other and said two left cantered supports being one in front of the other;

c. at the right or left abutment location mounting a right or left length of a lower support which comprises two cable directing means at the lateral end thereof, one of said cable directing means being substantially in-line with one right or left cantered support and the other of said cable directing means being substantially in-line with the other right or left cantered support near the associated abutment; and at the left or right abutment location mounting a left or right length of a lower support, or functional equivalent, which comprises two cable directing means at the lateral end thereof, one of said cable directing means being substantially in-line with one left or right cantered support and the other of said cable directing means being substantially in-line with the other left or right cantered support near the associated abutment;

d. attaching a tension cable to the tops of said right and left cantered supports which are in front of the other right and left cantered supports and causing it to proceed through the respective cable directing means; and attaching a tension cable to the tops of said right and left cantered supports which are behind the other right and left cantered supports and causing it to proceed through the respective cable directing means at the ends of the lengths of the lower supports at the right and left; and e. placing additional lengths of lower support between the right and left lengths of lower supports; and securing suspension cables between the tops of both said right and left cantered supports to said lower support centrally between both said right and left cantered supports.

It is noted that one of the "lengths of a lower support which comprises two cable directing means at one end thereof" mounted in Step "c" can be other than a permanent "length of a lower support", and serve only to provide the "two cable directing means at one end thereof". It is functionally the presence of the two cable directing means at each end of the Lower Support which is important.

It is noted that the method will typically involve providing tension producing devices (eg. turnbuckles), to produce tension in the tension cable, however an additional step, after production of tension thereby, can be to bypass and eliminate said tension producing device. The bypass can be effected via affixing lengths of tension cable around the tension producing device, and then optionally removing the tension producing device.

The disclosed invention will be better understood by reference to the Detailed Description in combination with the Drawings.

SUMMARY OF THE INVENTION

It is therefore a primary purpose and/or objective of the disclosed invention to teach a Modified Suspension Bridge which has a continuous Tension Cable (TC) in place of counter weights.

DETAILED DESCRIPTION

Figure 1:
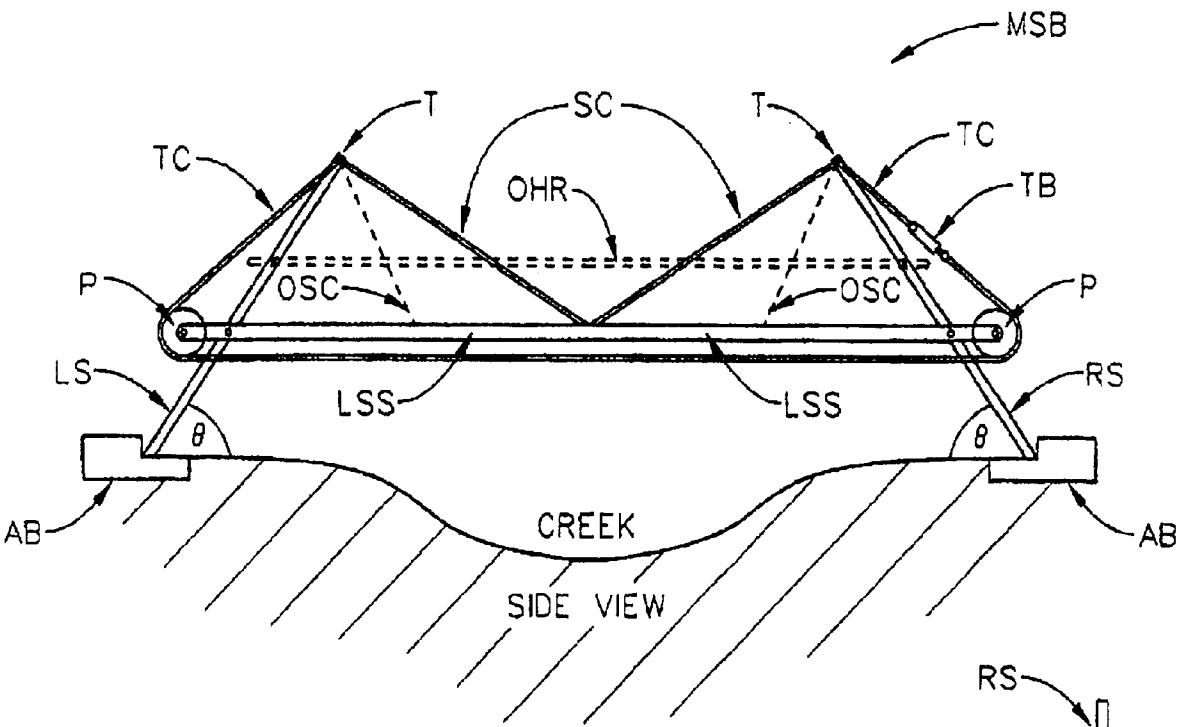
FIG. 1 shows the overall construction of the disclosed new Modified Suspension Bridge.

The present invention is a variation of a Suspension Bridge, which is herein termed a Modified Suspension Bridge (MSB). FIG. 1 shows that the (MSB) comprises Abutments (AB), Right (RS) and Left (LS) Supports, a Lower Support (LSS), Support Cables (SC), a Tension Cable (TC), Cable Directing Means (P) and a Turnbuckle (TB). Note that said Right (RS) and left (LS) Cantered Supports are shown extending from said Abutments (AB) at angles offset from vertical and have said Suspension Cables (SC) fixed to the tops (T) thereof, the distal ends of said Suspension Cables (SC) being fixed centrally on the Lower Support (LSS). While not limiting, the Angle (θ) is typically selected to be between 45 and 60 degrees. Additional Optional Suspension Cables (OSC) can also be present as well as an Optional Handrail (OHR). Note that the Lower support (LSS) has a Cable Directing Means (eg. Pulley), (P) on each end, which are freely rotating. Also note that said Tension Cable (TC) is fixedly attached to the tops of the Right (RS) and left (LS) Cantered Supports, and that said Tension Cable (TC) passes over said Cable Directing Means (P) and passes under said Lower Support (LSS). The Turnbuckle (TB) is included to allow creating Tension in said Tension Cable. Note that applying tension in the Tension Cable via said Turnbuckle (TB) causes compression is said Lower Support (LSS). (Note, the Pulleys (P) or functional equivalents can be smaller than shown in FIG. 1 so that the Tension Cable (TC) flushly contacts the bottom of the Lower Support (LSS)). In fact said Tension Cable (TC) can be affixed to the Lower Support (LSS) at various lengths therealong to enhance support of the Lower Support (LSS)).

The Lower Support (LSS) can be made of many sections which attach to one-another, as can the Right (RS) and left (LS) Cantered Supports. Sectional construction makes assembly more easily handled at remote sites.

It is also noted that the lengths of the Right (RS) and Left (LS) Support below the Lower Support (LSS) can be reduced to place the Lower Support (LSS) more even with the Abutments (AB), so as to reduce the need to build ramps to the upper surface of the Lower Support (LSS) to allow access thereto in use. That is the Lower Support (LSS) can be positioned more like those shown in FIGS. 2 and 3.

Figure 4:
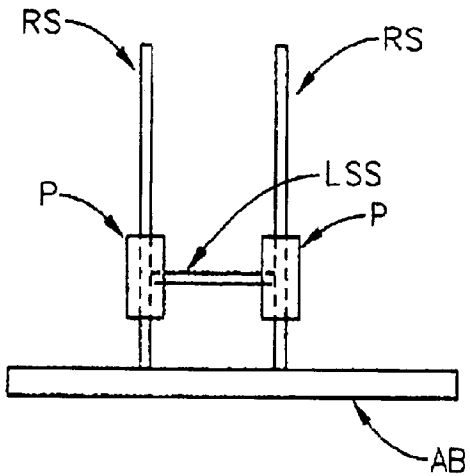
FIG. 4 shows two half-bridge systems offset from one another as viewed in frontal elevation, (eg. as viewed at an entry/exit to the bridge at the right in FIG. 1).

FIG. 4 shows two half-bridge systems, (both identified as (RS) for consistency with FIG. 1), aligned one in front of the other as viewed in side elevation, but offset from one another as viewed in frontal elevation, (eg. as viewed entry/exit to the bridge at the right side in FIG. 1). Said half-bridge systems (RS) are secured in relative position with respect to one another, via interconnection means and the elongated lower support (LSS). Also shown are the presence of Cable Directing Means (P) on each side. Other elements in FIG. 1 are not shown in FIG. 4, as FIG. 4 is included only to show how two bridge sections, (indicatd as (RS)), orient with respect to one another.

Figure 2:
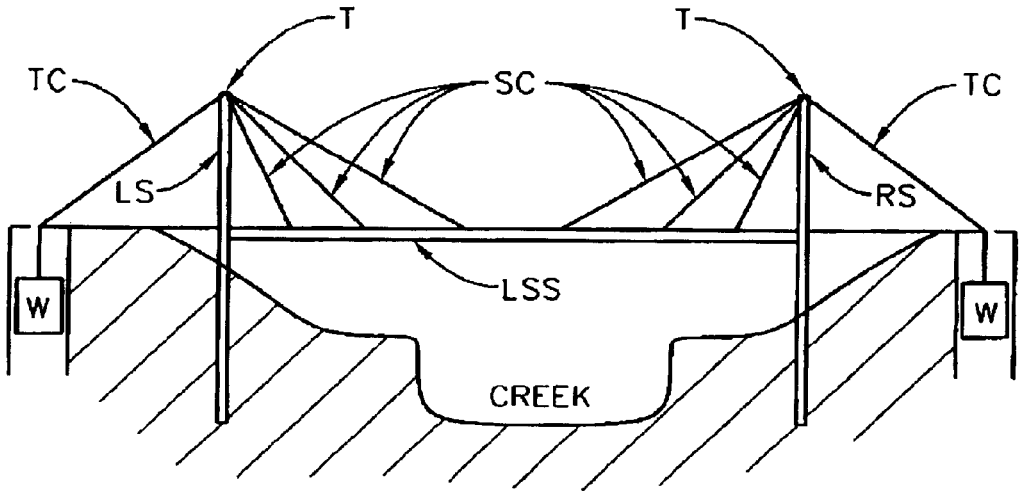
PRIOR ART FIG. 2
FIG. 2 demonstrates a more conventional Suspension Bridge.
Figure 3:
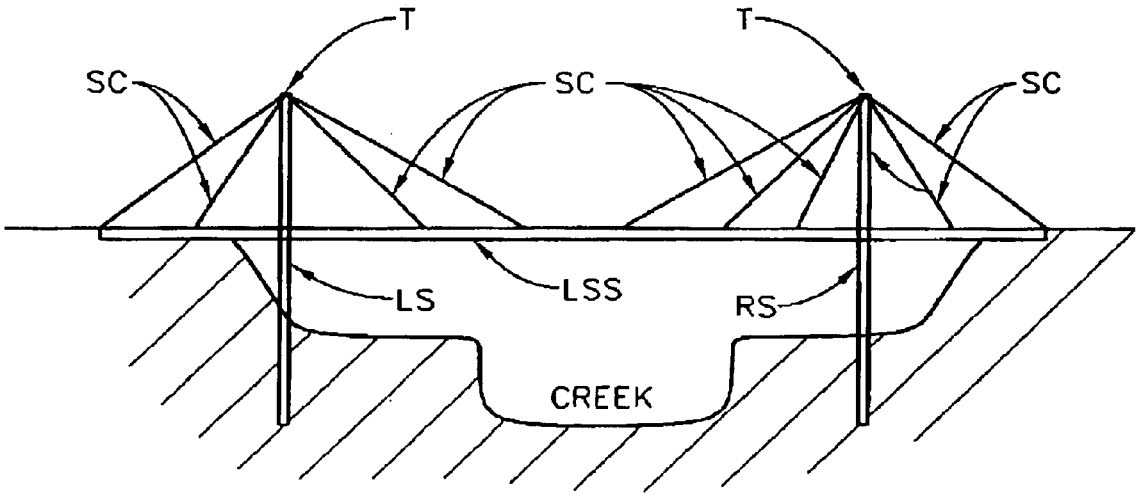
PRIOR ART FIG. 3
FIG. 3 shows a conventional Cable Stayed Bridge.

To contrast the presently disclosed invention, FIGS. 2 and 3 are presented to demonstrate Conventional Suspension and Cable-Stayed Bridges.

FIG. 2 shows a Prior Art conventional Suspension Bridge with Weights (W) present to counter balance the forces supported by Suspension Cables (SC), which project only centrally to the Lower Support (LSS).

A Prior Art Cable-Stayed Bridge is generally demonstrated in FIG. 3. Note that the Right (RS) and Left (LS) Supports are positioned more centrally than is the case in the FIG. 2 Suspension Bridge, and that Suspension Cables (SC) extend to both the right and left therefrom. The lateral lengths of Lower Support (LSS) serve the function of the Weights (W) in FIG. 2. Note also that the FIG. 3 Stayed-Cable Bridge- Right (RS) and Left (LS) Supports are placed closer to a spanned creek than are the analogically equivalent Right (RS) and Left (LS) Supports in FIG. 2.

The invention disclosed in FIG. 1, it should be appreciated provides maximum span distance between Right (RS) and Left (LS) Supports, it being greater than that provided by the Conventional Suspension and Cable-Stayed Bridges shown in FIGS. 2 and 3. Simultaneously the requirement of Counter-Weights is eliminated. It is noted that the Compressed Lower Support (LSS), serves a greater role in providing structural integrity in the disclosed invention than is the case in most Bridges.

It should be clear that a major difference of the present invention Modified Suspension Bridge (MSB), compared to more conventional Suspension and Cable-Stayed Bridges, is that the Tension Cable (TC) is continuous and that no counter weights (W) are required. The Lower Support (LSS) is from going down by the Suspension Cables (SC), and its own weight prevents it from. rising. Further, affixing said the Tension Cable (TC) to the Lower Support (LSS) at locations along the length thereof can stabilize the Bridge even further by coupling the Compression and Tension bearing elements.

It is noted that the Lower Support (LSS) serves the purpose of what is commonly termed the Deck in Bridges.

Having hereby disclosed the subject matter of the present invention, it should be obvious that many modifications, substitutions, and variations of the present invention are possible in view of the teachings. It is therefore to be understood that the invention may be practiced other than as specifically described, and should be limited in its breadth and scope only by the Claims.

What is claimed is:

1. A bridge system comprising:

an elongated lower support which comprises cable directing means at each end thereof;

a cantered right support;

a cantered left support;

a tension cable with a tension producing means therein; and suspension cables;

said right and left cantered supports being cantered toward the longitudinal center of the bridge span, said right and left cantered supports being affixed to underlying right and left abutments respectively;

at least one suspension cable being fixed to the top of said right cantered support and another of said at least one suspension cable being affixed to the left cantered support, and each cable thereof being affixed to the elongated lower support centrally between said right and left cantered supports;

said tension cable being affixed to the tops of said right and left cantered supports and being continuously strung under said elongated lower support through said cable directing means at the ends of said lower support.

2. A bridge system as in claim 1, in which the elongated lower support is comprised of many sections.

3. A bridge system as in claim 1, in which the tension cable has a turnbuckle or functional equivalent therewithin which is used to develop tension in said tension cable.

4. A bridge system comprising right and left half-bridge systems, each of which comprises:

a cantered right support;

a cantered left support;

a tension cable with a tension producing means therein; and suspension cables;

said right and left cantered supports being cantered toward the longitudinal center of the bridge span, said right and left cantered supports being affixed to underlying right and left abutments respectively;

said bridge system further comprising an elongated lower support which comprises cable directing means at each end thereof;

each of said right and left half-bridge systems having at least one suspension cable affixed to the top of said right cantered support and another of said at least one suspension cable being affixed to the left cantered support, and each of said cables being affixed to the elongated lower support centrally between said right and left cantered supports;

each of said right and left bridge half-sections having said tension cable affixed to the tops of said right and left cantered supports and continuously strung under said elongated lower support through said cable directing means at the ends of said lower support;

said right and left half-bridge systems being offset from one another and supporting a bridge deck disposed therebetween; and said right and left half-bridge systems being secured in relative position with respect to one another, via interconnection means and said elongated lower support.

5. A bridge system as in claim 4, in which the elongated lower support is comprised of many sections.

6. A bridge system as in claim 4, in which at least one tension cable has a turnbuckle or functional equivalent therewithin.

7. A method of constructing a modified suspension bridge comprising the steps of:

a. providing right and left abutments separated by a distance;

b. mounting two right and two left cantered supports, upon respective right and left abutments; such that said cantered supports are cantered toward the longitudinal center of the bridge span, which is disposed between said cantered supports;

c. above said right and left abutments; mounting corresponding right and left lower support assemblies, which each comprise cable directing means at the peripheral ends of said lower supports, one of said cable directing means being substantially in-line with one right or left cantered support and the other of said cable directing means being substantially in-line with the other right or left cantered support near the associated abutment; and at the left or right abutment location mounting a left or right length of a lower support, or functional equivalent, which comprises two cable directing means at the lateral end thereof, one of said cable directing means being substantially in-line with one left or right cantered support and the other of said cable directing means being substantially in-line with the other left or right cantered support near the associated abutment;

d. attaching a tension cable to the tops of said right and left cantered supports which are in front of the other right and left cantered supports and causing it to proceed through the respective cable directing means; and attaching a tension cable to the tops of said right and left cantered supports which are behind the other right and left cantered supports and causing it to proceed through the respective cable directing means at the ends of the lengths of the lower supports at the right and left; and e. placing additional lengths of lower support between the right and left cantered supports of lower supports; and securing suspension cables between the tops of both said right and left cantered supports to said lower support centrally between both said right and left cantered supports.

* * * * *